US011211198B2

(12) United States Patent
Saito et al.

(10) Patent No.: US 11,211,198 B2
(45) Date of Patent: Dec. 28, 2021

(54) METHOD FOR MANUFACTURING POWDER MAGNETIC CORE, AND METHOD FOR MANUFACTURING ELECTROMAGNETIC COMPONENT

(71) Applicants: SUMITOMO ELECTRIC INDUSTRIES, LTD., Osaka (JP); SUMITOMO ELECTRIC SINTERED ALLOY, LTD., Takahashi (JP)

(72) Inventors: Tatsuya Saito, Osaka (JP); Tomoyuki Ueno, Osaka (JP); Koji Yamada, Takahashi (JP)

(73) Assignees: SUMITOMO ELECTRIC INDUSTRIES, LTD., Osaka (JP); SUMITOMO ELECTRIC SINTERED ALLOY, LTD., Takahashi (JP)

( * ) Notice: Subject to any disclaimer, the term of this patent is extended or adjusted under 35 U.S.C. 154(b) by 179 days.

(21) Appl. No.: 16/634,169

(22) PCT Filed: Aug. 3, 2018

(86) PCT No.: PCT/JP2018/029163
§ 371 (c)(1),
(2) Date: Jan. 27, 2020

(87) PCT Pub. No.: WO2019/031399
PCT Pub. Date: Feb. 14, 2019

(65) Prior Publication Data

US 2020/0234876 A1 Jul. 23, 2020

(30) Foreign Application Priority Data

Aug. 10, 2017 (JP) ..... JP2017-156043

(51) Int. Cl.
*H01F 41/02* (2006.01)
*B22F 1/02* (2006.01)
(Continued)

(52) U.S. Cl.
CPC ..... *H01F 41/0246* (2013.01); *B22F 1/02* (2013.01); *H01F 1/24* (2013.01); *H01F 27/255* (2013.01)

(58) Field of Classification Search
None
See application file for complete search history.

(56) References Cited

U.S. PATENT DOCUMENTS

2004/0161600 A1* 8/2004 Igarashi ..... H01F 1/24 428/328
2011/0227690 A1 9/2011 Watanabe et al.
(Continued)

FOREIGN PATENT DOCUMENTS

JP 2000-223308 A 8/2000
JP 2003-105480 A 4/2003
(Continued)

OTHER PUBLICATIONS

International Search Report and Written Opinion dated Sep. 18, 2018 for PCT/JP2018/029163 filed on Aug. 3, 2018, 8 pages including English Translation of the International Search Report.

*Primary Examiner* — Xiaowei Su
(74) *Attorney, Agent, or Firm* — Xsensus LLP

(57) ABSTRACT

A method for manufacturing a powder magnetic core includes: a step of preparing a soft magnetic powder and an oxide powder and preparing, as a raw material powder, a mixed powder of the soft magnetic powder and the oxide powder, the soft magnetic powder containing composite soft magnetic particles containing pure iron and an Fe-α alloy having an element α more oxidizable than Fe, the composite
(Continued)

soft magnetic particles each having a core-shell structure where a core is made of one of pure iron and the Fe-α alloy and a shell is made of the other, the oxide powder containing oxide particles containing at least one selected from Fe and an element β that forms an oxide having higher electrical resistance than $Fe_3O_4$; a step of compacting the mixed powder into a green compact; and a step o sintering the green compact at 900° C. or more and 1300° C. or less.

20 Claims, 1 Drawing Sheet

(51) Int. Cl.
*H01F 1/24* (2006.01)
*H01F 27/255* (2006.01)

(56) References Cited

U.S. PATENT DOCUMENTS

| | | | | |
|---|---|---|---|---|
| 2013/0298730 | A1 | 11/2013 | Ikeda et al. | |
| 2014/0104023 | A1* | 4/2014 | Yang | B22F 1/02 335/297 |
| 2014/0138569 | A1* | 5/2014 | Otsuka | H01F 27/255 252/62.54 |

FOREIGN PATENT DOCUMENTS

| | | | |
|---|---|---|---|
| JP | 2011-29605 | A | 2/2011 |
| JP | 2012-191192 | A | 10/2012 |
| JP | 2016-157753 | A | 9/2016 |
| JP | 2016-213306 | A | 12/2016 |
| JP | 2017-11073 | A | 1/2017 |
| JP | 2017-45892 | A | 3/2017 |

* cited by examiner

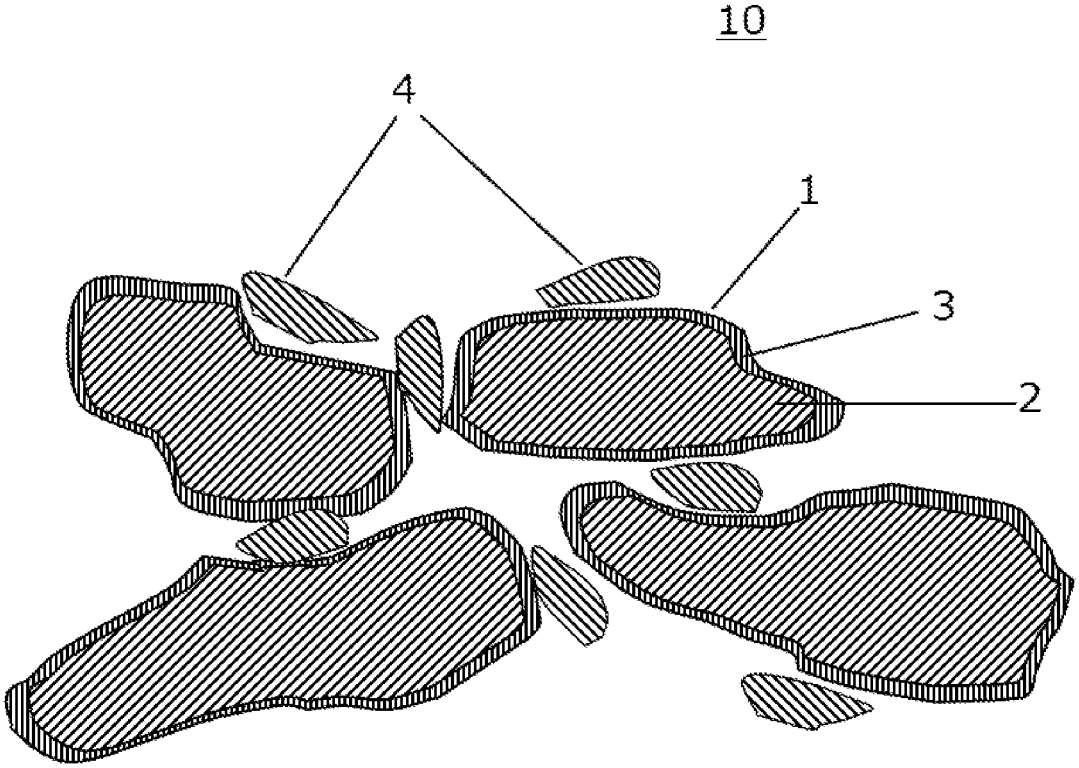
10
4
1
3
2

METHOD FOR MANUFACTURING POWDER MAGNETIC CORE, AND METHOD FOR MANUFACTURING ELECTROMAGNETIC COMPONENT

TECHNICAL FIELD

The present disclosure relates to a method for manufacturing a powder magnetic core and a method for manufacturing an electromagnetic component. This application claims priority to Japanese Patent Application No. 2017-156043 filed Aug. 10, 2017, which is incorporated herein by reference in its entirety.

BACKGROUND ART

Patent Literature 1 and Patent Literature 2 disclose that a powder magnetic core is manufactured by compacting an insulator-coated soft magnetic powder, which is used as a raw material powder, including soft magnetic particles having surfaces coated with silicone resin, and then subjecting the compact to a heat treatment.

CITATION LIST

Patent Literature

PTL 1: Japanese Unexamined Patent Application Publication No. 2000-223308

PTL 2: Japanese Unexamined Patent Application Publication No. 2011-29605

SUMMARY OF INVENTION

A method for manufacturing a powder magnetic core according to the present disclosure includes:

a step of preparing a soft magnetic powder and an oxide powder and preparing, as a raw material powder, a mixed powder of the soft magnetic powder and the oxide powder, the soft magnetic powder containing composite soft magnetic particles containing pure iron and an Fe-α alloy having an element α more oxidizable than Fe, the composite soft magnetic particles each having a core-shell structure where a core is made of one of pure iron and the Fe-α alloy and a shell is made of the other, the oxide powder containing oxide particles containing at least one selected from Fe and an element β that forms an oxide having higher electrical resistance than $Fe_3O_4$;

a step of compacting the mixed powder into a green compact; and a step of sintering the green compact at 900° C. or more and 1300° C. or less.

A method for manufacturing an electromagnetic component is a method for manufacturing an electromagnetic component including a coil formed of a winding and a powder magnetic core on which the coil is disposed.

The method includes:

a step of manufacturing the powder magnetic core by using the method for manufacturing a powder magnetic core according to the present disclosure; and a step of disposing the coil on the powder magnetic core.

BRIEF DESCRIPTION OF DRAWING

FIG. 1 is a schematic cross-sectional view of an example mixed powder according to an embodiment of the present disclosure.

DESCRIPTION OF EMBODIMENTS

To suppress heat generation of an electromagnetic component, a powder magnetic core needs to have low iron loss (core loss). One of measures to reduce the core loss of a powder magnetic core is formation of an insulating coating on the surfaces of soft magnetic particles that constitute the powder magnetic core to improve electrical insulation between the soft magnetic particles and reduce the core loss caused by eddy current loss of the powder magnetic core. In addition, a powder magnetic core needs to have high saturation magnetic flux density. To increase saturation magnetic flux density, it is advantageous to increase the density of the powder magnetic core.

For the powder magnetic cores described in Patent Literature 1 and Patent Literature 2, a soft magnetic powder including soft magnetic particles having surfaces with a silicone resin insulating coating is used as a raw material powder. The soft magnetic powder is compacted and then subjected to a heat treatment. For resin insulating coating, the insulating coating may be damaged by friction between the soft magnetic particles or the like during compaction to degrade electrical insulation. The temperature of the heat treatment is limited by resin heat-resistant temperature, and the maximum heat treatment temperature needs to be about 800° C. or less, which causes a problem where the heat treatment cannot be performed at a higher temperature. The heat treatment at a higher temperature (e.g., 900° C. or more) accelerates single crystallization of soft magnetic particles and improves magnetic properties to reduce the core loss of the particles themselves. In this case, however, the resin insulating coating is degraded by heat to impair electrical insulation, and thus the total core loss of the powder magnetic core increases.

Iron-based alloys, such as Fe—Si alloy, have higher hardness and lower plastic deformation than pure iron because of the solid solution effect of additive elements. In the case where a soft magnetic powder made of an iron-based alloy is used as a raw material powder, a larger amount of an additive element in the alloy results in higher hardness and lower plastic deformation, which makes difficult densification of the powder magnetic core.

The inventors of the present invention have found that densification and core loss reduction are achieved by using, as a raw material powder, a mixed powder of oxide powder and composite soft magnetic powder having a core-shell structure containing pure iron and an Fe-α alloy containing an element more oxidizable than Fe. The ease of oxidization is determined on the basis of the magnitude of the standard Gibbs free energy of formation of an oxide. An element α that forms an oxide having a smaller standard Gibbs free energy of formation than Fe oxides is determined to be more oxidizable than Fe. First, embodiments of the present disclosure will be listed and described.

(1) A method for manufacturing a powder magnetic core according to the present disclosure includes:

a step of preparing a soft magnetic powder and an oxide powder and preparing, as a raw material powder, a mixed powder of the soft magnetic powder and the oxide powder, the soft magnetic powder containing composite soft magnetic particles containing pure iron and an Fe-α alloy having an element α more oxidizable than Fe, the composite soft magnetic particles each having a core-shell structure where a core is made of one of pure iron and the Fe-α alloy and a shell is made of the other, the oxide powder containing oxide particles containing at least one selected from Fe and an element β that forms an oxide having higher electrical resistance than $Fe_3O_4$;

a step of compacting the mixed powder into a green compact; and a step of sintering the green compact at 900° C. or more and 1300° C. or less.

In the method for manufacturing a powder magnetic core, a mixed powder of oxide powder and composite soft magnetic powder having a core-shell structure containing pure iron and an Fe-α alloy is used as a raw material powder. The core or the shell of the composite soft magnetic particle is made of pure iron, and a pure iron portion contained in each composite soft magnetic particle is plastically deformed during compaction. Therefore, the use of composite soft magnetic powder as raw material powder can improve plastic deformation during compaction and can increase the density of a green compact (powder magnetic core). Furthermore, during sintering of the green compact of the mixed powder, interdiffusion occurs between the core and the shell in the composite soft magnetic particle. The element α contained in the Fe-α alloy is diffused into pure iron, the soft magnetic particles that constitute the powder magnetic core are formed of an Fe-α alloy, and the amount of the element α in the soft magnetic particles falls in a predetermined range.

According to the method for manufacturing a powder magnetic core, sintering the green compact of the mixed powder can form an oxide insulating coating with high electrical insulation on entire surfaces of the soft magnetic particles. Thus, the method for manufacturing a powder magnetic core enables the powder magnetic core to have high density and low core loss.

The mechanism of insulating coating formation in the method for manufacturing a powder magnetic core may be as described below.

First, the soft magnetic powder includes composite soft magnetic particles containing pure iron and an Fe-α alloy. The presence of the element α, which is more oxidizable than Fe, facilitates formation of an insulating coating on the surfaces of soft magnetic particles. In the sintering step, the element α in the composite soft magnetic particles is diffused into pure iron to form soft magnetic particles made of the Fe-α alloy, and the element α is oxidized through the oxidation-reduction reaction between the element α in the surface layer of the soft magnetic particle and the oxide particle to form an insulating coating made of an oxide of the element α on the surface layer of the soft magnetic particle. In this case, the soft magnetic particles are formed of an Fe-α alloy, and the element α is present in the surface layer. This configuration improves wettability between the soft magnetic particle and the oxide particle, and the oxide particles in the form of liquid phase during sintering are easily spread on the surfaces of the soft magnetic particles. As a result, the entire surfaces of the particles can be covered with the insulating coating. The remaining oxide particles not involved in the oxidation-reduction reaction form an insulating coating on the surfaces of the soft magnetic particles. In the case where an oxide of the element β that forms an oxide having higher electrical resistance than $Fe_3O_4$ is selected as an oxide powder, an insulating coating made of the oxide of the element β and having higher electrical resistance can be formed to improve electrical insulation between the soft magnetic particles.

In the method for manufacturing a powder magnetic core, sintering at 900° C. or more can promote element diffusion in the composite soft magnetic particle and can promote the oxidation-reduction reaction between the soft magnetic particle and the oxide particle to form an insulating coating on the surface of the soft magnetic particle. Sintering at 900° C. or more accelerates single crystallization of the soft magnetic particle and improves magnetic properties to reduce core loss. Since the insulating coating is formed of an oxide with high heat resistance, the insulating coating is not degraded by heat during sintering at 900° C. or more and can maintain its electrical insulation. At a temperature of 1300° C. or less, rapid progress of solid phase sintering between the soft magnetic particles is unlikely to occur before the insulating coating is formed on the surface of the soft magnetic particle through the oxidation-reduction reaction.

(2) In an aspect of the method for manufacturing a powder magnetic core, an amount of the oxide powder in the mixed powder is 0.1 mass % or more and 10 mass % or less.

When the amount of the oxide powder is 0.1 mass % or more, it is easy to form an insulating coating on the entire surfaces of soft magnetic particles that constitute the powder magnetic core. When the amount of the oxide powder is 10 mass % or less, the deterioration in magnetic properties, such as saturation magnetic flux density, due to a low proportion of the soft magnetic powder (soft magnetic particles) in the powder magnetic core can be prevented or reduced.

(3) In an aspect of the method for manufacturing a powder magnetic core, the soft magnetic powder has a mean particle size of 5 μm or more and 500 μm or less.

When the soft magnetic powder (composite soft magnetic particles) has a mean particle size of 5 μm or more, the soft magnetic particles are unlikely to have a large specific surface area, and the amount of the oxide powder for forming an insulating coating can be reduced. When the soft magnetic powder (composite soft magnetic particles) has a mean particle size of 500 μm or less, the eddy current loss generated in soft magnetic particles that constitute the powder magnetic core can be prevented or reduced to reduce core loss.

(4) In an aspect of the method for manufacturing a powder magnetic core, the green compact has a relative density of 88% or more.

When the green compact having a relative density of 88% or more is formed in the compacting step, the powder magnetic core can be sufficiently densified to improve good magnetic properties, such as saturation magnetic flux density. The maximum relative density of the green compact is not limited but, for example, 99% or less. The "relative density" as used herein refers to a proportion of actual density to true density (percentage of [measured density of green compact/true density of green compact]). The true density is the density of the raw material powder (mixed powder).

(5) In an aspect of the method for manufacturing a powder magnetic core, the element α is at least one element selected from B, Al, Si, Ti, and Cr.

The elements B, Al, Si, Ti, and Cr are more oxidizable than Fe, and iron-based alloys (Fe-α alloys) containing these elements have good magnetic properties. These elements are thus suitable as the element α. Examples of Fe-α alloys include Fe—B alloy, Fe—Al alloy, Fe—Si alloy, Fe—Ti alloy, Fe—Cr alloy, Fe—Si—Al alloy, Fe—Al—Cr alloy, and Fe—Si—Cr alloy. The element α in the Fe-α alloy contained in the composite soft magnetic particles diffuses in the composite soft magnetic particles during sintering and forms an oxide insulating coating on the surface layer of the soft magnetic particles through the oxidation-reduction reaction between the element α and the oxide powder (oxide particles). Examples of the oxide of the element α include $B_2O_3$, $Al_2O_3$, $SiO_2$, $TiO_2$, and $Cr_2O_3$.

(6) In an aspect of the method for manufacturing a powder magnetic core, Fe in the Fe-α alloy is partially substituted by at least one element σ selected from Co, Ni, and Mn.

When Fe in the Fe-α alloy is partially substituted by the element σ, the magnetic properties of the soft magnetic particles that constitute the powder magnetic core can be improved. The amount of the element σ in the soft magnetic particles is, for example, 1 mass % or more and 85 mass % or less.

(7) In an aspect of the method for manufacturing a powder magnetic core, the element β is at least one element selected from Mg, Al, Si, Cr, Ni, Mn, and Ti.

Since the elements Mg, Al, Si, Cr, Ni, Mn, and Ti form an oxide having higher electrical resistance than $Fe_3O_4$, the use of oxides of these elements as oxide powder can form an insulating coating of an oxide having higher electrical resistance than Fe oxides. Examples of oxides of the element β include MgO, $Al_2O_3$, $SiO_2$, $Cr_2O_3$, $NiO_2$, $MnO_2$, and $TiO_2$. Examples of Fe oxides include FeO, $Fe_2O_3$, and $Fe_3O_4$. The oxide powder may be one of Fe oxides and oxides of the element β, or a mixture of two or more of these oxides, or a composite oxide containing Fe and the element β. The "composite oxide" as used herein refers to an oxide composed of an Fe oxide (Fe—O component) and an oxide of the element β (β-O component). Examples of the composite oxide include $MgFe_2O_4$ ($Fe_2O_3$/MgO), $FeAl_2O_4$ (FeO/$Al_2O_3$), $Fe_2SiO_4$ (2FeO/$SiO_2$), $FeCr_2O_4$ (FeO/$Cr_2O_3$), $NiFe_2O_4$ (FeO/$FeNiO_3$), $MnFe_2O_4$ (FeO/$FeMnO_3$), and $FeTiO_3$ (FeO/$TiO_2$).

(8) In an aspect of the method for manufacturing a powder magnetic core, the composite soft magnetic particles are produced by mechanically milling a powder of the pure iron and a powder of the Fe-α alloy so that surfaces of particles of one of the powders are covered with particles of the other powder adhering thereto to form the core and shell.

Mechanical milling of the powder of the pure iron and the powder of the Fe-α alloy can produce composite soft magnetic particles having a core-shell structure containing pure iron and the Fe-α alloy. In this case, the mean particle size of the other powder that forms the shell is preferably smaller than the mean particle size of the one powder that forms the core. With this configuration, the surfaces of particles of the one powder can be covered with particles of the other powder adhering thereto by means of mechanical milling.

(9) In an aspect of the method for manufacturing a powder magnetic core according to (8), the ratio of a mean particle size of the one powder that forms the core and is one of the powder of the pure iron and the powder of the Fe-α alloy to a mean particle size of the other powder that forms the shell is 4 or more and 25 or less.

When the ratio (AB) of the mean particle size (A) of the one powder that forms the core to the mean particle size (B) of the other powder that forms the shell is 4 or more and 25 or less, the particles of the other powder adhere to the surfaces of the particles of the one powder easily and uniformly, and the shell with uniform thickness is easily formed so as to cover the entire core.

(10) In an aspect of the method for manufacturing a powder magnetic core, the composite soft magnetic particles are produced by covering surfaces of particles of a powder of one of the pure iron and the Fe-α alloy with the other by using vapor deposition to form the core and the shell.

The coverage of the surfaces of particles of a powder of one of the pure iron and the Fe-α alloy with the other by using vapor deposition can produce composite soft magnetic particles having a core-shell structure containing pure iron and the Fe-α alloy. Vapor deposition may be either physical vapor deposition (PVD) or chemical vapor deposition (CVD).

(11) In an aspect of the method for manufacturing a powder magnetic core, the sintering step includes a first step of sintering at 900° C. or more and 1200° C. or less and a second step of sintering at a temperature that is higher than that of the first step and is 1100° C. or more and 1300° C. or less.

When the sintering step is performed in two steps, the first step and the second step, the first step involves promoting element diffusion in the composite soft magnetic particle to sufficiently diffuse the element α in the particle, and the subsequent second step involves promoting the oxidation-reduction reaction between the soft magnetic particle and the oxide particle to form an insulating coating made of an oxide of the element α on the surface of the soft magnetic particle. It is thus easy to stably form an insulating coating on the surface of the soft magnetic particle, which can prevent or reduce the eddy current loss to reduce core loss.

(12) A method for manufacturing an electromagnetic component according to the present disclosure is a method for manufacturing an electromagnetic component including a coil formed of a winding and a powder magnetic core on which the coil is disposed, and the method includes:

a step of manufacturing the powder magnetic core by using the method for manufacturing a powder magnetic core according to any one of (1) to (11); and a step of disposing the coil on the powder magnetic core.

Since the powder magnetic core manufactured by using the above method for manufacturing a powder magnetic core is used as a magnetic core of the electromagnetic component according to the method for manufacturing an electromagnetic component, an electromagnetic component including a powder magnetic core having high density and low core loss can be manufactured. Examples of the electromagnetic component including a coil and a powder magnetic core on which the coil is disposed include motors and reactors.

Details of Embodiments

Specific examples of the method for manufacturing a powder magnetic core and the method for manufacturing an electromagnetic component according to the embodiments of the present disclosure will be described below.

<Method for Manufacturing Powder Magnetic Core>

A method for manufacturing a powder magnetic core according to an embodiment includes: a preparation step, which is a step of preparing, as a raw material powder, a mixed powder of soft magnetic powder and oxide powder; a compacting step, which is a step of compacting the mixed powder into a green compact; and a sintering step, which is a step of sintering the green compact. One of characteristics of the method for manufacturing a powder magnetic core according to this embodiment is that oxide powder and composite soft magnetic powder having a core-shell structure containing pure iron and an Fe-α alloy containing an element more oxidizable than Fe are used. Each step will be described below in detail.

<Preparation Step>

The preparation step is a step of preparing a soft magnetic powder and an oxide powder and preparing, as a raw material powder, a mixed powder of the soft magnetic powder and the oxide powder. The soft magnetic powder includes composite soft magnetic particles containing pure iron and an Fe-α alloy having an element α more oxidizable than Fe. The composite soft magnetic particles each have a core-shell structure where a core is made of one of pure iron and the Fe-α alloy and a shell is made of the other. The oxide powder includes oxide particles containing at least one selected from Fe and an element β that forms an oxide having higher electrical resistance than $Fe_3O_4$. Referring to FIG. 1, a mixed powder 10 includes composite soft magnetic particles 1 and oxide particles 4. The oxide particles 4 are disposed between the composite soft magnetic particle 1 and the composite soft magnetic particle 1. In the composite soft magnetic particle 1, the core 2 is covered with the shell 3.

(Soft Magnetic Powder)

The soft magnetic powder is composed of the composite soft magnetic particles 1 having a core-shell structure containing pure iron and an Fe-α alloy having an element α more oxidizable than Fe. The soft magnetic powder contains one of pure iron and the Fe-α alloy in the core 2 and the other in the shell 3. The "pure iron" as used herein refers to iron with a purity of 99 mass % or more. The composite soft magnetic particle 1 undergoes interdiffusion between the core 2 and the shell 3 in the sintering step described below so that the element α contained in the Fe-α alloy is diffused into pure iron, resulting in soft magnetic particles made of the Fe-α alloy after sintering. In other words, the soft magnetic particles that constitute the powder magnetic core after sintering are formed of the Fe-α alloy. The element α is, for example, at least one element selected from B, Al, Si, Ti, and Cr. Examples of Fe-α alloys include Fe—B alloy, Fe—Al alloy, Fe—Si alloy, Fe—Ti alloy, Fe—Cr alloy, Fe—Si—Al alloy, Fe—Al—Cr alloy, and Fe—Si—Cr alloy. The amount of the element α in the Fe-α alloy contained in the composite soft magnetic particles 1 is appropriately controlled so as to obtain a predetermined composition that allows soft magnetic particles (Fe-α alloy) that constitute the powder magnetic core after sintering to have good magnetic properties. Examples of the amount (mass %) of the element α in the composite soft magnetic particles when the illustrated iron-based alloys are used as the Fe-α alloy are described below. The amount described below is the amount of the element α relative to the total composite soft magnetic particles containing pure iron and the Fe-α alloy.

Fe—B alloy; B: 5% or more and 25% or less

Fe—Al alloy; Al: 1% or more and 8% or less

Fe—Si alloy; Si: 1% or more and 8% or less

Fe—Ti alloy; Ti: 1% or more and 8% or less

Fe—Cr alloy; Cr: 1% or more and 20% or less

Fe—Al—Si alloy; Al: 1% or more and 10% or less, Si: 1% or more and 15% or less

Fe—Al—Cr alloy; Al: 1% or more and 8% or less, Cr: 1% or more and 20% or less

Fe—Si—Cr alloy; Si: 1% or more and 8% or less, Cr: 1% or more and 20% or less

In addition, Fe in the Fe-α alloy may be partially substituted by at least one element σ selected from Co, Ni, and Mn. The partial substitution of Fe in the Fe-α alloy by the element σ can improve the magnetic properties of soft magnetic particles that constitute the powder magnetic core. The amount of the element σ is, for example, 1 mass % or more and 85 mass % or less relative to the total composite soft magnetic particles 1.

The soft magnetic powder (composed of composite soft magnetic particles) has a mean particle size of, for example, 5 μm or more and 500 μm or less. When the soft magnetic powder has a mean particle size of 5 μm or more, the soft magnetic particles are unlikely to have a large specific surface area, and the amount of the oxide powder described below can be reduced. When the soft magnetic powder has a mean particle size of 500 μm or less, the eddy current loss generated in soft magnetic particles that constitute the powder magnetic core can be prevented or reduced to reduce core loss. The "mean particle size" as used herein refers to the particle size at the 50% cumulative mass determined by using a laser diffraction/scattering particle size/particle size distribution analyzer. Specifically, a laser diffraction/scattering particle size distribution analyzer MT3300EXII available from Microtrac, Inc. is used. The measurement condition is dry condition, the measurement time is 10 seconds, and the powder load is 2 g. The mean particle size of other powders is also measured by using the same analyzer under the same measurement condition. The soft magnetic powder preferably has a mean particle size of, for example, 20 μm or more and 300 μm or less.

(Method for Manufacturing Composite Soft Magnetic Particles 1)

The composite soft magnetic particles 1 having a core-shell structure are produced by, for example, mechanically milling a powder of pure iron and a powder of the Fe-α alloy so that the surfaces of particles of one of the powders are covered with particles of the other powder adhering thereto to form the core 2 and shell 3. In this case, the mean particle size of the other powder that forms the shell 3 is preferably smaller than the mean particle size of the one powder that forms the core 2. With this configuration, the surfaces of particles of the one powder can be covered with particles of the other powder adhering thereto by means of mechanical milling. The ratio (A/B) of the mean particle size (A) of the one powder that forms the core 2 and is one of the powder of pure iron and the powder of the Fe-α alloy to the mean particle size (B) of the other powder that forms the shell 3 is, for example, preferably 4 or more and 25 or less, and more preferably 6 or more and 20 or less. At such a ratio, the particles of the other powder easily and uniformly adhere to the surfaces of the particles of the one powder, and the shell 3 with uniform thickness is easily formed so as to cover the entire core 2. In mechanical milling, for example, a high-energy ball mill, such as a vibrating mill or an attritor, or a hybridization system (high-speed gas impact method) can be used.

Another method for producing the composite soft magnetic particles 1 involves, for example, covering the surfaces of particles of a powder of one of pure iron and an Fe-α alloy with the other by using vapor deposition to form the core 2 and the shell 3. Vapor deposition may be either physical vapor deposition (PVD) or chemical vapor deposition (CVD).

(Oxide Powder)

The oxide powder is composed of the oxide particles 4 formed of an oxide containing at least one selected from an Fe oxide and an element β that forms an oxide having higher electrical resistance than $Fe_3O_4$. The oxide powder is a source for forming an insulating coating on the surfaces of soft magnetic particles that constitute the powder magnetic core. The oxide powder may be one of Fe oxides and oxides of the element β, or a mixture of two or more of these oxides, or a composite oxide containing Fe and the element β. Examples of the Fe oxides include FeO, $Fe_2O_3$, and $Fe_3O_4$. The element β is, for example, at least one element selected from Mg, Al, Si, Cr, Ni, Mn, and Ti. Examples of the oxides of the element β include MgO, $Al_2O_3$, $SiO_2$, $Cr_2O_3$, $NiO_2$, $MnO_2$, and $TiO_2$. Examples of the composite oxide include $MgFe_2O_4$, $FeAl_2O_4$, $Fe_2SiO_4$, $FeCr_2O_4$, $NiFe_2O_4$, $MnFe_2O_4$, and $FeTiO_3$.

The mean particle size of the oxide powder (composed of oxide particles) is preferably smaller than the mean particle size of the soft magnetic powder (composite soft magnetic particles). The oxide particles having a smaller mean particle size than the soft magnetic powder are dispersed between the composite soft magnetic particles when the soft magnetic powder is mixed with the oxide powder. This facilitates formation of an insulating coating on the surfaces of soft magnetic particles that constitute the powder magnetic core in the sintering step described below. The oxide powder has a mean particle size of, for example, preferably 1 μm or more and 15 μm or less and more preferably 2 μm or more and 10 μm or less.

The amount of the oxide powder in the mixed powder 10 is, for example, 0.1 mass % or more and 10 mass % or less. When the amount of the oxide powder is 0.1 mass % or more, it is easy to form an insulating coating on the entire surfaces of soft magnetic particles that constitute the powder magnetic core. When the amount of the oxide powder is 10 mass % or less, the deterioration in magnetic properties, such as saturation magnetic flux density, due to a low proportion of the soft magnetic powder (soft magnetic particles) in the powder magnetic core can be prevented or reduced. The amount of the oxide powder is preferably, for example, 0.3 mass % more and 5 mass % or less.

The raw material powder may further contain a lubricant. The lubricant can improve the compactibility of the mixed powder in the compacting step described below. The lubricant may be a solid lubricant, such as a fatty acid amide or metallic soap. Examples of the fatty acid amide include fatty acid amides, such as stearamide and ethylene bis stearamide. Examples of the metallic soap include metallic stearates, such as zinc stearate and lithium stearate.

<Compacting Step>

The compacting step is a step of compacting the mixed powder 10 into a green compact.

The compacting step involves charging the mixed powder 10 (raw material powder) into a mold and compacting the mixed powder 10 to form a green compact having a predetermined shape. A higher compacting pressure during compaction results in a higher relative density of the green compact, which enables densification of the green compact (powder magnetic core). The compacting pressure is, for example, preferably 600 MPa or more and more preferably 700 MPa or more. The maximum compacting pressure is not limited and, for example, 1500 MPa or less. To improve the compactibility of the mixed powder 10, for example, warm compaction may be performed by heating the mold. In this case, the compaction temperature (mold temperature) is, for example, 60° C. or more and 200° C. or less.

In this embodiment, plastic deformability during compaction can be improved since the core 2 or the shell 3 of the composite soft magnetic particle 1 is made of pure iron, and a pure iron portion contained in each composite soft magnetic particle 1 is plastically deformed during compaction.

The relative density of the green compact is, for example, 88% or more. When the relative density of the green compact is 88% or more, the powder magnetic core can be sufficiently densified to improve magnetic properties, such as saturation magnetic flux density. The relative density of the green compact is preferably 90% or more and more preferably 94% or more. The maximum relative density of the green compact is not limited but, for example, 99% or less. The relative density of the green compact is obtained by dividing the measured density of the green compact by the true density. The theoretical density of the mixed powder is defined as true density.

<Sintering Step>

The sintering step is a step of sintering the green compact at 900° C. or more and 1300° C. or less.

The sintering step involves sintering the green compact of the mixed powder. The sintering step causes the element α in the composite soft magnetic particles to be diffused into pure iron to form soft magnetic particles made of the Fe-α alloy and forms an oxide insulating coating on the surfaces of soft magnetic particles that constitute the powder magnetic core. The insulating coating is assumed to be formed as described below.

The soft magnetic powder is composed of the composite soft magnetic particles 1 containing pure iron and the Fe-α alloy where the element α is more oxidizable than Fe. In the sintering step, the element α in the composite soft magnetic particles 1 is diffused into pure iron to form soft magnetic particles made of the Fe-α alloy, and the element α is oxidized through the oxidation-reduction reaction between the element α in the surface layer of the soft magnetic particle and the oxide particle to form an insulating coating made of an oxide of the element α on the surface layer of the soft magnetic particle. In this case, the presence of the element α in the surface layer of the soft magnetic particle improves wettability between the soft magnetic particle and the oxide particle, and the oxide particles in the form of liquid phase during sintering are easily spread on the surfaces of the soft magnetic particles. As a result, the entire surfaces of the particles can be covered with the insulating coating. Therefore, the insulating coating made of an oxide of the element α in the composite soft magnetic particles 1 is formed through the oxidation-reduction reaction during sintering. Examples of the oxide of the element α include $B_2O_3$, $Al_2O_3$, $SiO_2$, $TiO_2$, and $Cr_2O_3$. The remaining oxide particles 4 not involved in the oxidation-reduction reaction form an insulating coating on the surfaces of the soft magnetic particles. The insulating coating may contain an oxide of Fe or the element β, or a composite oxide containing Fe and the element β. When an oxide containing the element β is used as an oxide powder, an insulating coating having high electrical resistance can be formed to improve electrical insulation between the soft magnetic particles.

In this embodiment, the composite soft magnetic particle 1 may have a core-shell structure where the core 2 is made of pure iron and the shell 3 is made of an Fe-α alloy, or may have a core-shell structure where the core 2 is made of an Fe-α alloy and the shell 3 is made of pure iron. Even in the core-shell structure where the core 2 is made of an Fe-α alloy and the shell 3 is made of pure iron, the element α in the Fe-α alloy can diffuse in the composite soft magnetic particles 1 during sintering and can form an oxide insulating coating on the surface layer of the soft magnetic particles through the oxidation-reduction reaction between the element α and the oxide powder oxide particles 4.

In the sintering step, sintering at 900° C. or more can promote element diffusion in the composite soft magnetic particle 1 and can promote the oxidation-reduction reaction between the soft magnetic particle and the oxide particle 4 to form an insulating coating on the surface of the soft magnetic particle. Sintering at 900° C. or more accelerates single crystallization of the soft magnetic particle and improves magnetic properties to reduce core loss. Since the insulating coating is formed of an oxide with high heat resistance, the insulating coating is not degraded by heat during sintering at 900° C. or more and can maintain its electrical insulation. At a sintering temperature of 1300° C. or less, rapid progress of solid phase sintering between the soft magnetic particles is unlikely to occur before the insulating coating is formed on the surface of the soft magnetic particle through the oxidation-reduction reaction. The sintering temperature is, for example, preferably 1000° C. or more and more preferably 1100° C. or more.

The sintering step may include a primary sintering step, which is a first step of sintering at 900° C. or more and 1200° C. or less, and a secondary sintering step, which is a second step of sintering at 1100° C. or more and 1300° C. or less. The sintering step may be performed in two steps. In this case, the temperature of the secondary sintering step is higher than the temperature of the primary sintering step. When the sintering step is performed in two steps in such a manner, the primary sintering step involves promoting element diffusion in the composite soft magnetic particle 1 to sufficiently diffuse the element α in the particle, and the subsequent secondary sintering step involves promoting the oxidation-reduction reaction between the soft magnetic particle and the oxide particle to form an insulating coating made of an oxide of the element α on the surface of the soft magnetic particle. In the case where the soft magnetic powder composed of the composite soft magnetic particles 1 having a core-shell structure where the core 2 is made of the Fe-α alloy and the shell 3 is made of pure iron is used for raw material powder, the absence of the element α in the surface layer of the composite soft magnetic particle 1 in the initial sintering stage leads to poor wettability between the composite soft magnetic particle 1 and the oxide particle 4 and makes it difficult to cause the oxidation-reduction reaction between the composite soft magnetic particle 1 and the oxide particle 4. It is thus difficult to form the insulating coating on the entire surface of the soft magnetic particle. Thus, for the core-shell structure where the core 2 is made of the Fe-α alloy and the shell 3 is made of pure iron, the sintering step including the primary sintering step and the secondary sintering step is preferably employed. In the primary sintering step, the element α in the core 2 (Fe-α alloy) is diffused into the shell 3 (pure iron) so that the element α is present in the surface layer of the soft magnetic particle. The presence of the element α in the surface layer facilitates formation of an insulating coating on the entire surface of the particle in the secondary sintering step.

For the core-shell structure where the core 2 is made of pure iron and the shell 3 is made of the Fe-α alloy, the presence of the element α in the surface layer of the composite soft magnetic particle 1 improves wettability between the composite soft magnetic particle 1 and the oxide particle 4 and facilitates formation of an insulating coating on the entire surface of the soft magnetic particle in the sintering step. However, in this case, a high concentration of the element α in the surface layer of the composite soft magnetic particle 1, that is, a large amount of the element α in the shell 3, makes it difficult to stably generate an oxide of the element α through the oxidation-reduction reaction between the composite soft magnetic particle 1 and the oxide particle 4, which may form only a thin insulating coating made of an oxide of the element α on the surface of the soft magnetic particle. As a result, more oxide particles not involved in the oxidation-reduction reaction remain, and it may be difficult to obtain a sufficient effect of reducing the eddy current loss. For the core-shell structure where the core 2 is made of pure iron and the shell 3 is made of the Fe-α alloy, the sintering step is performed in two steps, and the element α in the shell 3 (Fe-α alloy) is diffused into the core 2 (pure iron) to some extent in the primary sintering step to reduce the concentration (amount) of the element α in the surface layers of the soft magnetic particles. After the concentration of the element α in the surface layers is reduced to some extent in the primary sintering step, the oxidation-reduction reaction is promoted in the secondary sintering step. This facilitates stable generation of an oxide of the element α and formation of an insulating coating on the surfaces of the soft magnetic particles.

The sintering temperature in the primary sintering step is, for example, preferably 1000° C. or more and more preferably 1100° C. or more. The sintering temperature in the secondary sintering step is, for example, preferably more than 1200° C.

<<Effect>>

The method for manufacturing a powder magnetic core according to the embodiment described above exerts the following effect.

This method uses, as a raw material powder, a mixed powder of oxide powder and composite soft magnetic powder having a core-shell structure containing pure iron and an Fe-α alloy. The use of such a raw material powder can improve plastic deformation during compaction and enables densification of the green compact (powder magnetic core). In addition, during sintering of the green compact of the mixed powder, interdiffusion occurs between the core and the shell in the composite soft magnetic particle. The element α contained in the Fe-α alloy is diffused into pure iron, so that the soft magnetic particles that constitute the powder magnetic core are formed of an Fe-α alloy, and the amount of the element α in the soft magnetic particles falls in a predetermined range. Moreover, sintering the green compact of the mixed powder can form an oxide insulating coating on the surfaces of soft magnetic particles that constitute the powder magnetic core. The core loss can be thus reduced while the powder magnetic core can be densified. As a result, the powder magnetic core having high density and low core loss can be manufactured.

The powder magnetic core manufactured by the method for manufacturing a powder magnetic core according to the embodiment described above can be used as a magnetic core of an electromagnetic component. The powder magnetic core having high density and low core loss can improve the energy efficiency of an electromagnetic component.

<Method for Manufacturing Electromagnetic Component>

A method for manufacturing an electromagnetic component according to an embodiment includes: a step of manufacturing a powder magnetic core by using the method for manufacturing a powder magnetic core according to the embodiment described above; and a step of disposing a coil on the powder magnetic core. This method enables manufacture of an electromagnetic component including a coil formed of a winding and a powder magnetic core on which the coil is disposed.

Since the method for manufacturing an electromagnetic component according to the embodiment described above uses, as a magnetic core of the electromagnetic component, the powder magnetic core manufactured by the method for manufacturing a powder magnetic core according to the embodiment described above, an electromagnetic component including a powder magnetic core having high density and low core loss can be manufactured. Examples of the electromagnetic component include motors and reactors.

Test Example 1

A powder magnetic core was manufactured by using, as a raw material powder, a mixed powder of soft magnetic powder and oxide powder. The powder magnetic core was evaluated.

(Sample No. 1-1 to No. 1-9)

Various soft magnetic powders composed of composite soft magnetic particles having a core-shell structure where the core was made of pure iron (Fe) and the shell was made of an iron-based alloy (Fe-α alloy) having the composition (mass %) shown in Table 1 were prepared. The mean particle size of the prepared soft magnetic powders was about 120 μm. A powder (mean particle size: 8 μm) of a composite oxide made of $Fe_2SiO_4$ was prepared as an oxide powder. A mixed powder serving as a raw material powder of each sample was prepared by mixing the prepared soft magnetic powder with the prepared oxide powder. The amount of the oxide powder in the mixed powder was 2.0 mass %.

Each soft magnetic powder (composite soft magnetic particles) was produced as follows: preparing a pure iron powder and an alloy powder having the composition shown in Table 1; and mechanically milling the pure iron powder and the alloy powder by using high-energy balls to cover the particle surface of the pure iron powder with the alloy powder. The mean particle size of the prepared pure iron powder is 100 μm. The mean particle size of each alloy powder is 10 μm. The ratio (A/B) of the mean particle size (A) of the pure iron powder to the mean particle size (B) of the alloy powder is 10. The alloy powder in the addition amount shown in Table 1 was added to the pure powder such that the overall composition of the soft magnetic particles was the intended composition shown in Table 1.

Each prepared mixed powder was charged into a mold and compacted at a compacting pressure of 1380 MPa to produce a ring-shaped green compact 30 mm in outer diameter, 20 mm in inner diameter, and 5 mm in height. The weight and volume of each produced green compact were measured to calculate the measured density, and the relative density of each produced green compact was obtained from the measured density and the true density (theoretical density) of each mixed powder. The results are shown in Table 1.

Powder magnetic cores of Sample Nos. 1-1 to 1-9 shown in Table 1 were manufactured by sintering each produced green compact through a heat treatment at the heat treatment temperature shown in Table 1 for 60 minutes. Sample No. 1-4 was manufactured by performing sintering in two steps including a heat treatment (primary sintering) at 1000° C. for 60 minutes and a heat treatment (secondary sintering) at an elevated temperature of 1200° C. for 60 minutes.

(Sample Nos. 111 to 115)

Powder magnetic cores of Sample Nos. 111 to 115 shown in Table 1 were manufactured as comparison in the same manner as for Sample Nos. 1-1 and 1-6 to 1-9 except that an alloy powder (mean particle size: 100 μm) having the composition (mass %) shown in Table 1 was used as soft magnetic powder. In Sample Nos. 111 to 115, the composition of the entire soft magnetic particles is substantially uniform.

(Sample Nos. 116 to 117)

As shown in Table 1, powder magnetic cores of Sample Nos. 116 to 117 shown in Table 1 were manufactured in the same manner as for Sample Nos. 1-1 to 1-3 except that only the heat treatment temperature was changed.

The iron loss (core loss) of each of the manufactured powder magnetic core samples was measured. In this test, a primary winding of 300 turns and a secondary winding of 30 turns were placed around the powder magnetic core, and the iron loss (core loss) was measured by a secondary winding method. The measurement of the core loss was performed by using an alternating current BH analyzer (available from METRON, Inc.) at room temperature (25° C.). The measurement conditions were as follows: excitation magnetic flux density Bm 0.1 T (1 kG); and measurement frequency 20 kHz. The results are shown in Table 1.

TABLE 1

| | Raw Material Powder (Mixed Powder) | | | | | | | | Powder Magnetic Core |
|---|---|---|---|---|---|---|---|---|---|
| | Soft Magnetic Particle | | | | | | | | |
| | Intended | | Shell | | Oxide Particle | | Compact | Heat | Core |
| Sample No. | Composition (Overall Composition) | Core Composition | Composition | Addition Amount (mass %) | Composition | Addition Amount (mass %) | Relative Density (%) | Treatment Temperature (° C.) | Loss W1/20 k (kW/m³) |
| 1-1 | Fe-6.5% Si | Fe | Fe-18% Si | 36.1 | $Fe_2SiO_4$ | 2 | 95.3 | 1200 | 128 |
| 1-2 | Fe-6.5% Si | Fe | Fe-18% Si | 36.1 | $Fe_2SiO_4$ | 2 | 95.3 | 900 | 152 |
| 1-3 | Fe-6.5% Si | Fe | Fe-18% Si | 36.1 | $Fe_2SiO_4$ | 2 | 95.3 | 1300 | 142 |
| 1-4 | Fe-6.5% Si | Fe | Fe-18% Si | 36.1 | $Fe_2SiO_4$ | 2 | 95.3 | 1000 →1200 | 113 |
| 1-5 | Fe-6.5% Si | Fe | Fe-42% Si | 15.2 | $Fe_2SiO_4$ | 2 | 96.2 | 1200 | 120 |
| 1-6 | Fe-3.0% Si | Fe | Fe-18% Si | 16.7 | $Fe_2SiO_4$ | 2 | 95.9 | 1200 | 180 |
| 1-7 | Fe-2.0% Si | Fe | Fe-18% Si | 11.1 | $Fe_2SiO_4$ | 2 | 96.6 | 1200 | 202 |
| 1-8 | Fe-2.0% Al | Fe | Fe-50% Al | 4.0 | $Fe_2SiO_4$ | 2 | 96.1 | 1200 | 223 |
| 1-9 | Fe-13% Cr | Fe | Fe-66% Cr | 19.7 | $Fe_2SiO_4$ | 2 | 91.3 | 1250 | 29 |
| 111 | Fe-6.5% Si | | — | | $Fe_2SiO_4$ | 2 | 87.7 | 1200 | 161 |
| 112 | Fe-3.0% Si | | — | | $Fe_2SiO_4$ | 2 | 94.9 | 1200 | 201 |
| 113 | Fe-2.0% Si | | — | | $Fe_2SiO_4$ | 2 | 95.2 | 1200 | 223 |
| 114 | Fe-2.0% Al | | — | | $Fe_2SiO_4$ | 2 | 95.2 | 1200 | 252 |
| 115 | Fe-13% Cr | | — | | $Fe_2SiO_4$ | 2 | 90.1 | 1250 | 38 |
| 116 | Fe-6.5% Si | Fe | Fe-18% Si | 36.1 | $Fe_2SiO_4$ | 2 | 95.3 | 800 | 183 |
| 117 | Fe-6.5% Si | Fe | Fe-18% Si | 36.1 | $Fe_2SiO_4$ | 2 | 95.3 | 1350 | 430 |

The results in Table 1 indicate that, when samples where the soft magnetic particles have the same overall composition are compared with each other between Sample Nos. 1-1 to 1-9 manufactured by using a composite soft magnetic powder having a core-shell structure containing pure iron and an Fe-α alloy and Sample Nos. 111 to 115 manufactured by using a soft magnetic powder formed of the Fe-α alloy, the green compacts of Sample Nos. 1-1 to 1-9 have higher density and lower core loss than those of Sample Nos. 111 to 115. This may be because, in Sample Nos. 1-1 to 1-9, the core formed of pure iron in the composite magnetic particles facilitates plastic deformation during compaction to increase the density of the powder magnetic core and improve magnetic properties, resulting in low core loss. In Sample Nos. 111 to 115, the use of alloy powder in the soft magnetic powder degrades plastic deformation during compaction and inhibits densification of the green compact (powder magnetic core), resulting in high core loss.

The results of comparison between Sample Nos. 1-1 to 1-4 and Sample Nos. 116 and 117 reveal that the heat treatment temperature during sintering is preferably 900° C. or more and 1300° C. or less. The results of comparison between Sample No. 1-1 and Sample No. 1-4 reveal that Sample No. 1-4 subjected to two-step sintering has lower core loss than Sample No. 1-1 not subjected to two-step sintering. The reason for this is assumed as described below. At a high concentration of the element α (Si in this example) in the shell, the oxidation-reduction reaction occurs between Si in the surface layer of the soft magnetic particle and the oxide particle during sintering. However, the oxide Si—O generated in this reaction has low vapor pressure and is easily decomposed.

To deal with this issue, Si in the shell is diffused into the core to some extent in a heat treatment (primary sintering) in a first step to lower the Si concentration in the surface layer. The oxidation-reduction reaction is then promoted in a heat treatment (secondary sintering) in a second step. This two-step sintering facilitates generation of $SiO_2$, which is a more stable oxide, and facilitates formation of an insulating coating on the surface of the soft magnetic particle. The two-step sintering can prevent or reduce eddy current loss and can reduce core loss.

Test Example 2

(Sample No. 2-1 to No. 2-2)

A powder magnetic core of Sample No. 2-1 was manufactured in the same manner as for Sample No. 1-1 in Test Example 1 except that a soft magnetic powder (mean particle size: about 120 μm) composed of composite soft magnetic particles having a core-shell structure where the core was made of an Fe—Si alloy with the composition (mass %) shown in Table 2 and the shell was made of pure iron (Fe) was used. In Test Example 2, a soft magnetic powder (composite soft magnetic particles) was produced as follows: preparing a Fe—Si alloy powder having a mean particle size of 100 μm and a pure iron powder having a mean particle size of 10 μm; and mechanically milling the pure iron powder and the alloy powder to cover the particle surface of the alloy powder with the pure iron powder. The ratio (AB) of the mean particle size (A) of the pure iron powder to the mean particle size (B) of the alloy powder is 10. The pure powder in the addition amount shown in Table 2 was added to the alloy powder such that the overall composition of the soft magnetic particles was the intended composition shown in Table 2.

Moreover, a powder magnetic core of Sample No. 2-2 was manufactured by using the same raw material powder (mixed powder) as for Sample No. 2-1 in the same manner as for Sample No. 2-1 except two-step sintering. The sintering conditions of Sample No. 2-2 were a heat treatment (primary sintering) at 1000° C. for 60 minutes and a subsequent heat treatment (secondary sintering) at an elevated temperature of 1200° C. for 60 minutes.

The iron loss (core loss) of each of the manufactured powder magnetic cores of Sample Nos. 2-1 and 2-2 was measured in the same manner as in Test Example 1. The results are shown in Table 2.

TABLE 2

| | Raw Material Powder (Mixed Powder) | | | | | | | | Powder Magnetic Core |
|---|---|---|---|---|---|---|---|---|---|
| | Soft Magnetic Particle | | | | | | | | |
| | Intended | | Shell | | Oxide Particle | | Compact | Heat | Core |
| Sample No. | Composition (Overall Composition) | Core Composition | Composition | Addition Amount (mass %) | Composition | Addition Amount (mass %) | Relative Density (%) | Treatment Temperature (° C.) | Loss W1/20 k (kW/m³) |
| 2-1 | Fe-6.5% Si | Fe-18% Si | Fe | 63.9 | $Fe_2SiO_4$ | 2 | 93.4 | 1200<br>1000 | 148 |
| 2-2 | Fe-6.5% Si | Fe-18% Si | Fe | 63.9 | $Fe_2SiO_4$ | 2 | 93.4 | →1200 | 133 |
| 111 | Fe-6.5% Si | | — | | $Fe_2SiO_4$ | 2 | 87.7 | 1200 | 161 |

Table 2 indicates that, like Sample No. 1-1 in Test Example 1, the green compacts of Sample Nos. 2-1 and 2-2 using a composite soft magnetic powder having a core-shell structure where the core is made of an Fe-α alloy (Fe—Si alloy in this example) and the shell is made of pure iron have higher density and lower core loss than that of Sample No. 111. The results of comparison between Sample No. 2-1 and Sample No. 2-2 reveal that Sample No. 2-2 subjected to two-step sintering has lower core loss than Sample No. 2-1 not subjected to two-step sintering. The reason for this is assumed as described below. For the core-shell structure where the shell is made of pure iron, the absence of Si in the surface layer of the composite soft magnetic particle makes it difficult to cause the oxidation-reduction reaction between the soft magnetic particle and the oxide particle. It is thus difficult to form an insulating coating on the entire surface of the soft magnetic particle. In two-step sintering, Si in the core is diffused into the shell in a heat treatment (primary sintering) in a first step so that Si is present in the surface layer. The presence of Si in the surface layer facilitates formation of an insulating coating on the surface of the soft magnetic particle in a heat treatment (secondary sintering) in a second step and results in low core loss.

Test Example 3

(Sample No. 3-1 to No. 3-4)

As shown in Table 3, powder magnetic cores of Sample Nos. 3-1 to 3-4 were manufactured in the same manner as for Sample No. 1-1 in Test Example 1 except that the amount of the oxide powder was changed. The iron loss (core loss) of each of the manufactured powder magnetic cores of Sample Nos. 3-1 to 3-4 was measured in the same manner as in Test Example 1. The results are shown in Table 3.

TABLE 3

| | Raw Material Powder (Mixed Powder) | | | | | | | | Powder Magnetic Core |
|---|---|---|---|---|---|---|---|---|---|
| | Soft Magnetic Particle | | | | | | | | |
| | Intended | | Shell | | Oxide Particle | | Compact | Heat | Core |
| Sample No. | Composition (Overall Composition) | Core Composition | Composition | Addition Amount (mass %) | Composition | Addition Amount (mass %) | Relative Density (%) | Treatment Temperature (° C.) | Loss W1/20 k (kW/m$^3$) |
| 1-1 | Fe-6.5% Si | Fe | Fe-18% Si | 36.1 | $Fe_2SiO_4$ | 2 | 95.3 | 1200 | 128 |
| 3-1 | Fe-6.5% Si | Fe | Fe-18% Si | 36.1 | $Fe_2SiO_4$ | 0.3 | 97.6 | 1200 | 106 |
| 3-2 | Fe-6.5% Si | Fe | Fe-18% Si | 36.1 | $Fe_2SiO_4$ | 10 | 91.2 | 1200 | 155 |
| 3-3 | Fe-6.5% Si | Fe | Fe-18% Si | 36.1 | $Fe_2SiO_4$ | 0.05 | 98.2 | 1200 | 451 |
| 3-4 | Fe-6.5% Si | Fe | Fe-42% Si | 15.2 | $Fe_2SiO_4$ | 15 | 86.5 | 1200 | 172 |

The results in Table 3 indicate that Sample Nos. 1-1, 3-1, and 3-2 where the amount of the oxide powder is 0.1 mass % or more and 10 mass % or less have much lower core loss than Sample Nos. 3-3 and 3-4 where the amount of the oxide powder is out of this range. This may be because, at 0.1 mass % or more of the oxide powder, an insulating coating is easily formed on the entire surfaces of soft magnetic particles that constitute the powder magnetic core, whereas at 10 mass % or less of the oxide powder, the degradation in magnetic properties due to a low proportion of the soft magnetic powder (soft magnetic particles) in the powder magnetic core is unlikely to occur.

Test Example 4

(Sample No. 4-1)

As shown in Table 4, a powder magnetic core of Sample No. 4-1 was manufactured in the same manner as for Sample No. 1-1 in Test Example 1 except that the type of oxide powder was changed by preparing a powder of oxide $Fe_2O_3$ as an oxide powder. The mean particle size of the prepared $Fe_2O_3$ oxide powder was 2 μm, and the amount of the oxide powder was 2.0 mass %.

(Sample No. 411)

A powder magnetic core of Sample No. 411 shown in Table 4 was manufactured as comparison in the same manner as for Sample No. 4-1 except that an Fe—Si alloy powder (mean particle size: 100 μm) having the composition (mass %) shown in Table 4 was used as soft magnetic powder.

The iron loss (core loss) of each of the manufactured powder magnetic cores of Sample No. 4-1 and No. 411 was measured in the same manner as in Test Example 1. The results are shown in Table 4.

Table 4 indicates that the green compact of Sample No. 4-1 using a composite soft magnetic powder having a core-shell structure containing pure iron and an Fe-α alloy has higher density and lower core loss than that of Sample No. 411 using a soft magnetic powder formed of an Fe-α alloy. The results of comparison between Sample No. 1-1 and Sample No. 4-1 reveal that the effect of reducing core loss by using, as an oxide powder, a composite oxide ($Fe_2SiO_4$ in this example) containing Fe and an element β is larger than that by using an Fe oxide ($Fe_2O_3$). The reason for this is assumed as described below. The composite oxide contains an Fe—O component and a β-O component. The presence of the Fe—O component improves wettability between the oxide powder and the soft magnetic particles made of the Fe-α alloy, and the oxide particles in the form of liquid phase during sintering are easily spread on the surfaces of the soft magnetic particles. As a result, the entire surfaces of the soft magnetic particles can more assuredly be covered with an insulating coating, and the insulating coating is more easily formed on the entire surfaces of the soft magnetic particles. Moreover, the presence of the 13-0 component enables formation of an insulating coating with high electrical resistance on the surfaces of the soft magnetic particles.

It should be understood that the embodiments disclosed herein are illustrative in any respect and non-restrictive from any viewpoint. The scope of the present invention is defined by the claims, rather than the above description, and is intended to include all modifications within the meaning and range of equivalency of the claims.

REFERENCE SIGNS LIST

1 Composite soft magnetic particle
2 Core

TABLE 4

| | Raw Material Powder (Mixed Powder) | | | | | | | | Powder Magnetic Core |
|---|---|---|---|---|---|---|---|---|---|
| | Soft Magnetic Particle | | | | | | | | |
| | Intended | | Shell | | Oxide Particle | | Compact | Heat | Core |
| Sample No. | Composition (Overall Composition) | Core Composition | Composition | Addition Amount (mass %) | Composition | Addition Amount (mass %) | Relative Density (%) | Treatment Temperature (° C.) | Loss W1/20 k (kW/m$^3$) |
| 1-1 | Fe-6.5% Si | Fe | Fe-18% Si | 36.1 | $Fe_2SiO_4$ | 2 | 95.3 | 1200 | 128 |
| 4-1 | Fe-6.5% Si | Fe | Fe-18% Si | 36.1 | $Fe_2O_3$ | 2 | 96.4 | 1200 | 142 |
| 411 | Fe-6.5% Si | | — | | $Fe_2O_3$ | 2 | 86.3 | 1200 | 328 |

3 Shell

4 Oxide particle

10 Mixed powder

The invention claimed is:

1. A method for manufacturing a powder magnetic core, the method comprising:

a step of preparing a soft magnetic powder and an oxide powder and preparing, as a raw material powder, a mixed powder of the soft magnetic powder and the oxide powder, the soft magnetic powder containing composite soft magnetic particles containing pure iron and an Fe-α alloy having an element α more oxidizable than Fe, the composite soft magnetic particles each having a core-shell structure where a core is made of one of pure iron and the Fe-α alloy and a shell is made of the other, the oxide powder containing oxide particles containing at least one selected from Fe and an element β that forms an oxide having higher electrical resistance than $Fe_3O_4$;

a step of compacting the mixed powder into a green compact; and a step of sintering the green compact at 900° C. or more and 1300° C. or less.

2. The method for manufacturing a powder magnetic core according to claim 1, wherein an amount of the oxide powder in the mixed powder is 0.1 mass % or more and 10 mass % or less.

3. The method for manufacturing a powder magnetic core according to claim 1, wherein the soft magnetic powder has a mean particle size of 5 μm or more and 500 μm or less.

4. The method for manufacturing a powder magnetic core according to claim 2, wherein the soft magnetic powder has a mean particle size of 5 μm or more and 500 μm or less.

5. The method for manufacturing a powder magnetic core according to claim 1, wherein the green compact has a relative density of 88% or more.

6. The method for manufacturing a powder magnetic core according to claim 2, wherein the green compact has a relative density of 88% or more.

7. The method for manufacturing a powder magnetic core according to claim 3, wherein the green compact has a relative density of 88% or more.

8. The method for manufacturing a powder magnetic core according to claim 1, wherein the element α is at least one element selected from B, Al, Si, Ti, and Cr.

9. The method for manufacturing a powder magnetic core according to claim 1, wherein Fe in the Fe-α alloy is partially substituted by at least one element σ selected from Co, Ni, and Mn.

10. The method for manufacturing a powder magnetic core according to claim 1, wherein the element β is at least one element selected from Mg, Al, Si, Cr, Ni, Mn, and Ti.

11. The method for manufacturing a powder magnetic core according to claim 1, wherein the composite soft magnetic particles are produced by mechanically milling a powder of the pure iron and a powder of the Fe-α alloy so that surfaces of particles of one of the powders are covered with particles of the other powder adhering thereto to form the core and shell.

12. The method for manufacturing a powder magnetic core according to claim 11, wherein a ratio of a mean particle size of the one powder that forms the core and is one of the powder of the pure iron and the powder of the Fe-α alloy to a mean particle size of the other powder that forms the shell is 4 or more and 25 or less.

13. The method for manufacturing a powder magnetic core according to claim 1, wherein the composite soft magnetic particles are produced by covering surfaces of particles of a powder of one of the pure iron and the Fe-α alloy with the other by using vapor deposition to form the core and the shell.

14. The method for manufacturing a powder magnetic core according to claim 1, wherein the sintering step includes a first step of sintering at 900° C. or more and 1200° C. or less and a second step of sintering at a temperature that is higher than that of the first step and is 1100° C. or more and 1300° C. or less.

15. A method for manufacturing an electromagnetic component including a coil formed of a winding and a powder magnetic core on which the coil is disposed, the method comprising:

a step of manufacturing the powder magnetic core by using the method for manufacturing a powder magnetic core according to claim 1; and a step of disposing the coil on the powder magnetic core.

16. A method for manufacturing a powder magnetic core, the method comprising:

a step of preparing a soft magnetic powder and an oxide powder and preparing, as a raw material powder, a mixed powder of the soft magnetic powder and the oxide powder, the soft magnetic powder containing composite soft magnetic particles containing pure iron and an Fe-α alloy having an element α more oxidizable than Fe, the composite soft magnetic particles each having a core-shell structure where a core is made of one of pure iron and the Fe-α alloy and a shell is made of the other, the oxide powder containing oxide particles containing at least one selected from Fe and an element β that forms an oxide having higher electrical resistance than $Fe_3O_4$;

a step of compacting the mixed powder into a green compact; and a step of sintering the green compact at 900° C. or more and 1300° C. or less, wherein the element α is at least one element selected from B, Al, Si, Ti, and Cr, and the element β is at least one element selected from Mg, Al, Si, Cr, Ni, Mn, and Ti.

17. The method for manufacturing a powder magnetic core according to claim 16, wherein the soft magnetic powder has a mean particle size of 5 μm or more and 500 μm or less.

18. The method for manufacturing a powder magnetic core according to claim 16, wherein the green compact has a relative density of 88% or more.

19. The method for manufacturing a powder magnetic core according to claim 4, wherein the green compact has a relative density of 88% or more.

20. The method for manufacturing a powder magnetic core according to claim 17, wherein the green compact has a relative density of 88% or more.

* * * * *